United States Patent [19]

Green

[11] 4,434,409

[45] Feb. 28, 1984

[54] DIELECTRIC WAVEGUIDE PHASE SHIFTER

[75] Inventor: Jerome J. Green, Lexington, Mass.

[73] Assignee: Raytheon Company, Lexington, Mass.

[21] Appl. No.: 272,809

[22] Filed: Jun. 11, 1981

[51] Int. Cl.[3] ..... H01P 1/195

[52] U.S. Cl. ..... 333/24.1; 333/248

[58] Field of Search ..... 333/24.1, 24.2, 157, 333/158, 159, 164, 239, 248, 17 L

[56] References Cited

U.S. PATENT DOCUMENTS

| | | | |
|---|---|---|---|
| 3,181,091 | 4/1965 | Augustine et al. | 333/159 |
| 3,425,001 | 1/1969 | Hershenov | 333/1.1 |
| 3,524,152 | 8/1970 | Agrios et al. | 333/24.1 |
| 3,761,845 | 9/1973 | Ajioka et al. | 333/24.1 |
| 3,824,502 | 7/1974 | Bardash et al. | 333/24.1 |
| 3,849,746 | 11/1974 | Mason et al. | 333/24.1 |
| 3,973,225 | 8/1976 | Hines | 333/24.1 |
| 4,001,733 | 1/1977 | Birch et al. | 333/24.1 |
| 4,007,541 | 2/1977 | Monforte et al. | 29/600 |
| 4,034,377 | 7/1977 | Knox et al. | 333/24.2 X |
| 4,122,418 | 10/1978 | Nagao . | |
| 4,342,010 | 7/1982 | Dixon, Jr. et al. | 333/17 L |

FOREIGN PATENT DOCUMENTS

| | | | |
|---|---|---|---|
| 55-88401 | 7/1980 | Japan | 333/158 |

*Primary Examiner*—Paul L. Gensler

*Attorney, Agent, or Firm*—Denis G. Maloney; Richard M. Sharkansky; Joseph D. Pannone

[57] ABSTRACT

A non-reciprocal latching phase-shifter uses a slab of a high-dielectric constant material embedded in ferrite to substantially concentrate the electromagnetic energy within the dielectric slab, thus eliminating the need for a conductive waveguide, and to provide for a small amount of energy leakage into the adjacent ferrite whose state of magnetization can be varied, thus providing for a variable phase-shift. In one embodiment, parallel high-K dielectric strips are sandwiched between grooved ferrite sheets to provide a low-cost phase-shifter array.

28 Claims, 12 Drawing Figures

DIELECTRIC WAVEGUIDE PHASE SHIFTER

BACKGROUND OF THE INVENTION

Phase-shifters have a wide variety of applications in microwave circuits. More specifically, phase-shifters have been used in phased array antennas to electronically produce a scanning beam. Of particular interest in these applications is the ferrimagnetic latching phase-shifter. It is generally constructed by inserting one or more ferrite toroids in a metal waveguide. Close tolerances must be maintained to avoid the generation of undesirable higher order modes in the minute air gaps between the surfaces of the ferrite and the waveguide. U.S. Pat. Nos. 3,761,845 and 4,001,733 are representative of the schemes developed to avoid this problem. However, they all involve additional manufacturing steps which, in the patents referenced above, require, respectively, wrapping a foil around a composite structure and plating the ferrite assembly.

Another problem of ferrimagnetic phase-shifters is that the thermal expansion of the metal waveguide is different from the thermal expansion of the ferrite material. This results in damaging stresses or unwanted movement of the ferrite core within the waveguide in addition to the problems caused by magnetostriction. U.S. Pat. No. 3,849,746 shows a possible mounting method that avoids this problem. However, this also has the disadvantage of requiring additional manufacturing steps.

SUMMARY OF THE INVENTION

This invention discloses a phase-shifter assembly which avoids these and other problems of conductive waveguide-type ferrimagnetic devices. This is achieved by eliminating the conductive waveguide walls and by using a high-K dielectric as the primary channel for the microwave energy. A cost advantage is also gained, since the number and difficulty of fabrication steps can be reduced. As used in this context, a high-K dielectric is a material having a dielectric constant greater than one order of magnitude of the dielectric constant of free space.

This invention provides for means for containing a propagating electromagnetic wave comprising a high-K dielectric slab, means comprising a dielectric interface for producing a predetermined amount of wave leakage from the surface of the slab, and means, disposed adjacent to the dielectric slab, for producing ferrimagnetic interaction with a portion of the leakage wave.

This invention further provides for a first and second sheet of ferrimagnetic material disposed parallel to each other, and a plurality of parallel dielectric bars disposed longitudinally between the first and second sheets. Each of the sheets have parallel longitudinal passages at a predetermined spacing from each other. The passages in the first sheet being adjacent corresponding passages in the second sheet, and each of said dielectric bars is disposed longitudinally between the two sheets in the region between oppositely adjacent passages.

BRIEF DESCRIPTION OF THE DRAWINGS

Other objects and advantages of the invention will be better understood from the following detailed description used in conjunction with the drawings in which like reference numbers refer to like parts and in which.

DESCRIPTION OF THE PREFERRED EMBODIMENT

Figure 1:
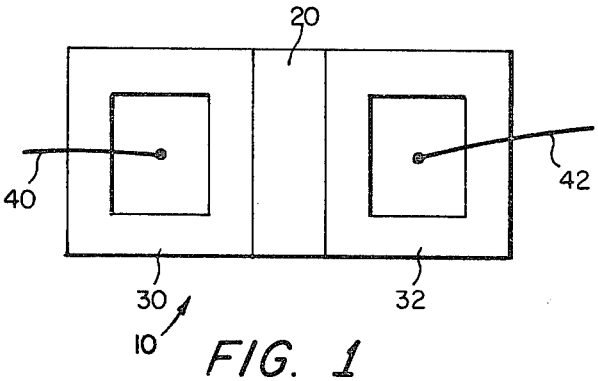
FIG. 1 shows an elevation view of the embodiment of the phase-shifter of the present invention.

Referring now to FIG. 1, there is shown an exemplary non-reciprocal twin ferrite slab dielectric waveguide phase-shifter 10 of the present invention. High-K rectangular slab 20 is positioned between two ferrite toroids 30 and 32 and is bonded thereto by any suitable means, such as an acrylic reactive adhesive, for instance, methyl methacrylate No. RA-0018 sold by H. B. Fuller, Saint Paul, Minn. The bond provides the required flexibility over the operating temperature range to relieve the stresses arising from the difference in coefficients of expansion between slab 20 and toroids 30 and 32. The high-K dielectric 20 is the primary channel for the microwave energy, and the RF fields outside the dielectric decay rapidly. This is achieved by selecting a dielectric constant K for the dielectric slab 20 that is several times that of the K for the ferrite toroids 30 and 32. Under this condition, the high-K slab 20 is entirely surrounded by a layer made up of lower-K dielectric materials, i.e. the adjacent leg of each ferrite toroid on two of the opposite sides of slab 20 and air on the remaining two sides. This structure provides a peripheral dielectric interface boundary between media having different dielectric constants, which results in an electromagnetically mismatched interface boundary and thus forms a dielectric waveguide. An applied electromagnetic wave, then, is guided along the core of this dielectric waveguide, since the impedance mismatching at the interface boundary serves to produce internal reflections, thus containing most of the energy. The mismatched interface boundary does allow a small portion of the applied wave to transmit through this layer, however the different dielectric constants are chosen to produce an exponentially decaying transmitted wave. Use of the dielectric waveguide also serves to reduce the size of the device for a predetermined amount of phase-shift. The reduced volume of the ferrite toroid has the cost advantage of requiring a lesser quantity of the normally expensive ferrite material and, in the case of a latching device, also requires less switching energy. Outside the dielectric slab 20, the exponentially decaying microwave energy penetrates only a portion of the adjacent legs of ferrite toroids 30 and 32 and is sufficient to provide the required phase-shifting without excessive coupling to the other legs of toroids 30 and 32.

Figure 2:
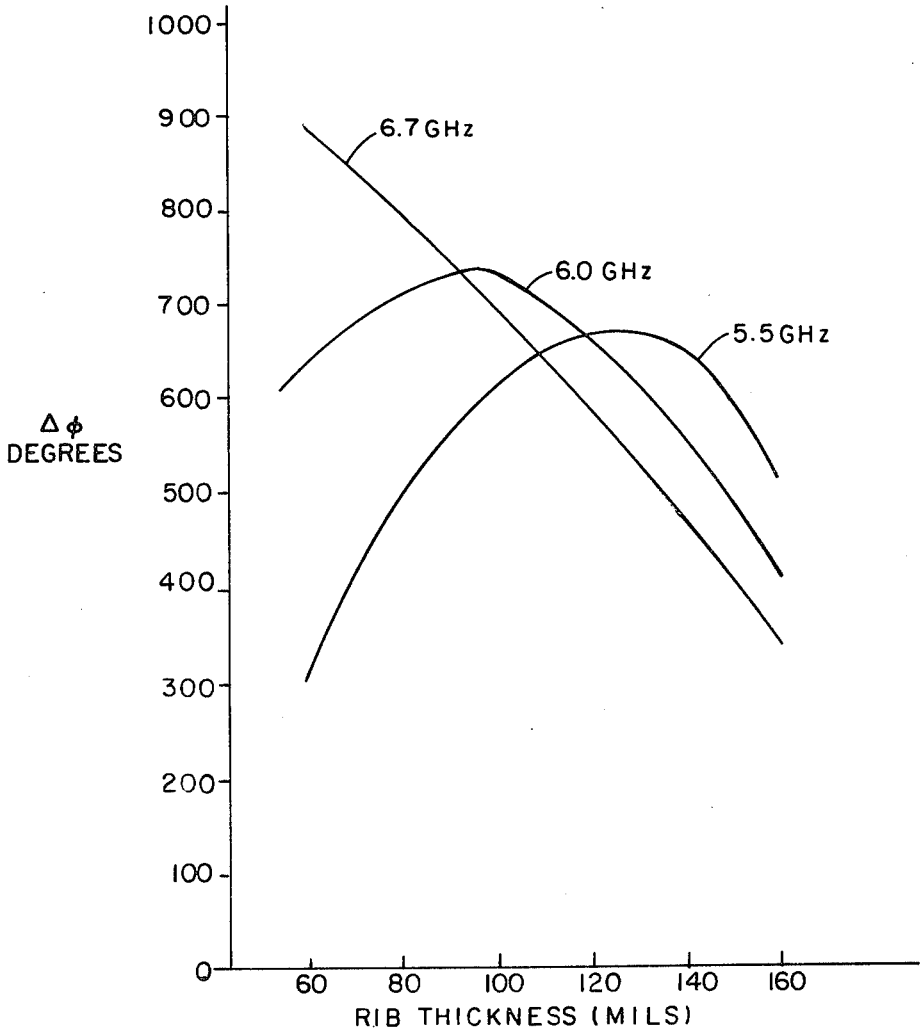
FIG. 2 shows a graph of achievable phase-shift as a function of the thickness of the dielectric slab for the phase-shifter of FIG. 1.

Switching wires 40 and 42 thread the length of toroids 30 and 32, respectively, and are used to supply the magnetizing current pulse. Other arrangements of switching wires may be used to provide the required magnetization. As is well known, the direction and duration of the current pulse is dictated by the amount and polarity of phase-shift required. The polarity of the current pulse flowing on wires 40 and 42 is the same so that the direction of the magnetic field induced in the leg of toroid 30 adjacent to slab 20 is opposite from the direction of the magnetic field induced in the corresponding adjacent leg of toroid 32. This provides for the non-reciprocal phase-shifting function. The ferrite region which makes the most significant contribution to the phase-shift is that of the legs immediately adjacent to the dielectric slab 20, since an applied electromagnetic wave decays rapidly outside dielectric slab 20. The remaining legs of the ferrite toroids are present to provide a closed flux path in the magnetic circuit and contribute little to the phase-shift, or to the insertion loss of the device. The device of FIG. 1 was constructed using a dielectric slab 250 mils high and 100 mils thick with a $K=50$ and ferrite toroids 5 in. long, 250 mils by 220 mils in cross-section, 55. mil thick legs, and $K=18$. All dielectric constants used herein are referenced to that of air, where for air $K=1$. The ferrite used is spinel ferrite whose saturation magnetization is 1200 Gauss. Its dielectric loss tangent is approximately $5\times10^{-4}$ and its dielectric constant is approximately 18. Any garnet or spinel ferrite can be used, however, to achieve a low insertion loss, the dielectric loss tangent should be less than $10^{-3}$ and its saturation magnetization, in Gauss, should be less than $0.8\times$Operating Frequency/$2.8\times10^{6}$. In general, the length of the device is dictated by the amount of phase-shift required, as is well known. To test the device, a set of matching transformers having three steps was used to couple a full-sized waveguide ($1.872''\times0.872''$) to a heavily dielectrically loaded reduced-height waveguide ($0.75''\times0.25''$) section. A dielectric plug was used to couple the reduced height waveguide to the device. For the device described above, the magnetization in the ferrite material is switched by means of wires which run longitudinally down the core of the ferrite toroid. By passing a current pulse of a predetermined polarity and time duration, the magnetic flux in the toroid can be set to any predetermined value between the two major hysteresis loop remanent magnetization states. The magnetic flux direction being clockwise or counter-clockwise in both toroids. Equal magnitude, but opposite direction for the magnetization in the two adjacent legs, is the common mode of operation. It is also possible to have a phase-shifter where the adjacent legs do not have opposite polarity and equal magnitude, but are varied in some other prescribed manner to produce a variable phase shift. The device just described has the following measured characteristics: insertion loss of 3.5 dB at 6 GHz, reflection coefficient of 4.5 dB at 6 GHz (VSWR=2.67), and saturation phase shift of 720° at 6.0 GHz, as seen on FIG. 2. Using a dielectric slab thickness of 60 mils, as normally found in dielectric loaded conductive waveguide phase-shifter, resulted in a device having a large reflection coefficient and having a tendency to radiate from the exposed portion of the dielectric slab. Different slab thickness were tried to obtain better containment of the microwave energy and reduce cross-coupling. FIG. 2 shows the phase-shift as a function of dielectric slab thickness for three different frequencies, 5.5 GHz, 6.0 GHz and 6.7 GHz. The phase-shift was measured by driving the ferrite toroids to saturation first in one direction, then in the other and measuring the change in phase-shift. For a slab thickness range of 100–120 mil, the phase-shift is large, around 600° and is almost independent of the frequency for the selected range. For thicker slabs, the phase-shift falls off, since the fields at the ferrite-slab interface are decreased, while for thinner slabs, the energy is not confined as well. One of the important guidelines for producing a device having useful characteristics is then the proper selection of the dimensions of the dielectric waveguide. For a rectangular dielectric slab, its thickness should be between 0.25 to 0.6 of the free space wavelength, $\lambda o$, divided by the square root of the relative dielectric constant of the slab, $K_s$, in order to provide for adequate containment of the propagating wave and still maintain adequate amounts of phase-shift. Optimum performance appears to occur when the dielectric slab thickness is approximately $0.35\ \lambda o/\sqrt{K_s}$.

Figure 3:
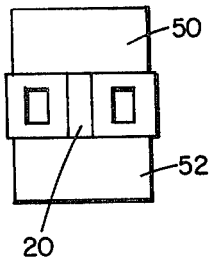
FIG. 3 shows an elevation view of another embodiment of the phase-shifter of the present invention.

In order to further characterize the performance of the device of FIG. 1, it is modified, as shown in FIG. 3, by the addition of ferrite slabs 50 and 52 over the exposed portion of dielectric slab 20. This is done to create an additional dielectric boundary over the two exposed sides in order to further contain the electromagnetic wave and reduce the cross-coupling between stacked devices in phase-shifter array applications. Measurements were taken at 5.5 GHz for the device of FIG. 3 using a dielectric slab thickness of 60 mils and an overall device length of 5 in., and the results are summarized in the following table next to similar measurements for a conventional waveguide-type phase-shifter.

TABLE I

| | Dielectric Device | Waveguide Device |
|---|---|---|
| Length | 5 in. | 5 in. |
| Insertion Loss | 3 dB | 2 dB |
| Reflection Coeff. | 9 dB (VSWR = 2.1) | 14 dB (VSWR = 1.5) |
| Phase Shift | 420° | 680° |
| Cross-Coupling | 10 dB | none |

Figure 4:
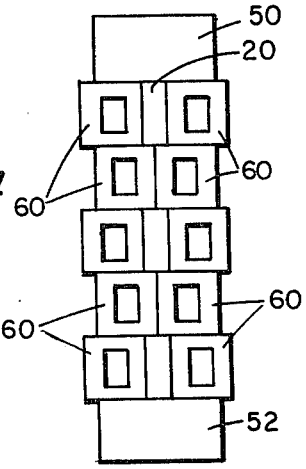
FIG. 4 shows an elevation view of the embodiment used to measure cross-coupling for the embodiment of FIG. 3.

The cross-coupling for the structure of FIG. 3 was measured by stacking similar structures to create a vertical array of phase-shifters, as is done in FIG. 4. Here the intermediate cladding is provided by ferrite toroids 60, which were used for their availability. However, they could be replaced by any dielectric having a dielectric constant greater than that of air and smaller than that of dielectric bar 20, such as ferrite slabs similar to the ferrite slabs 50 and 52.

Figure 5:
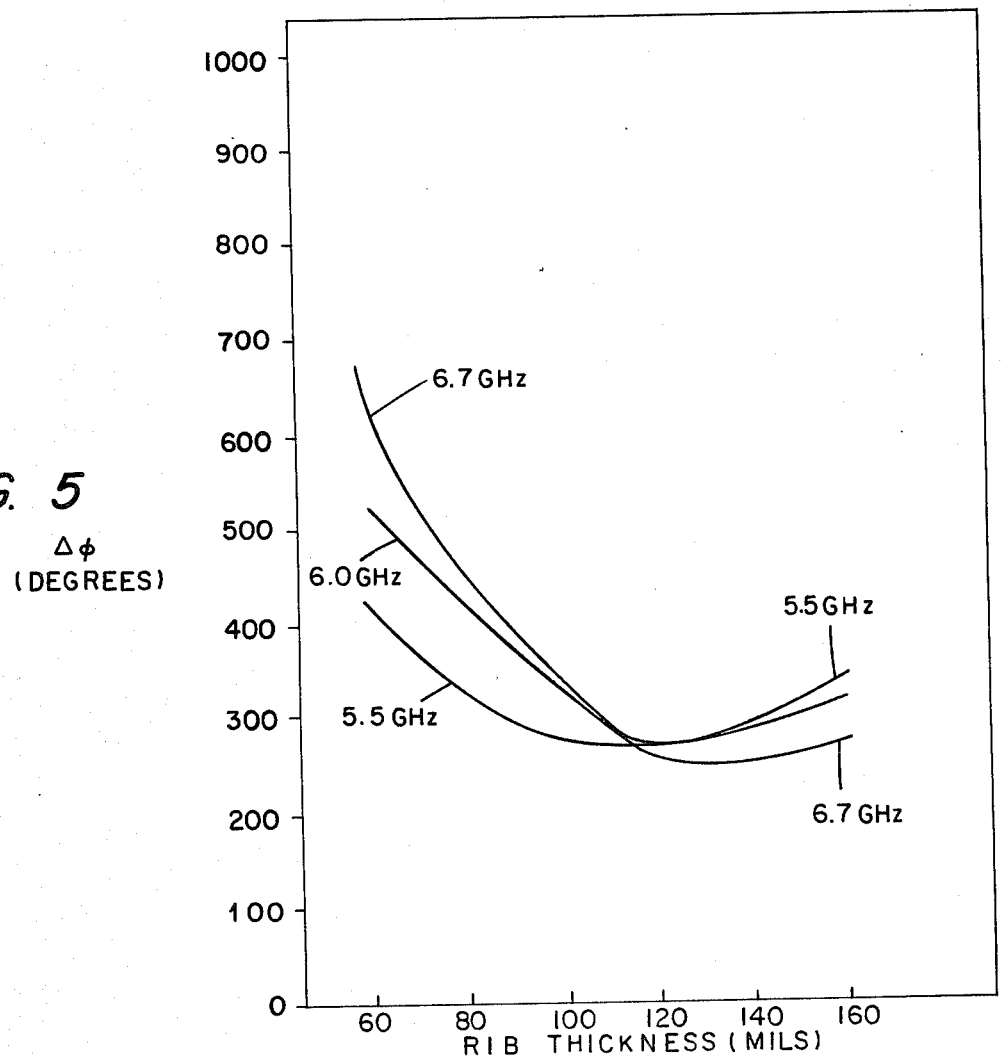
FIG. 5 shows a graph of achievable phase-shift as a function of the thickness of the dielectric slab for the embodiment of FIG. 3.
Figure 7A:
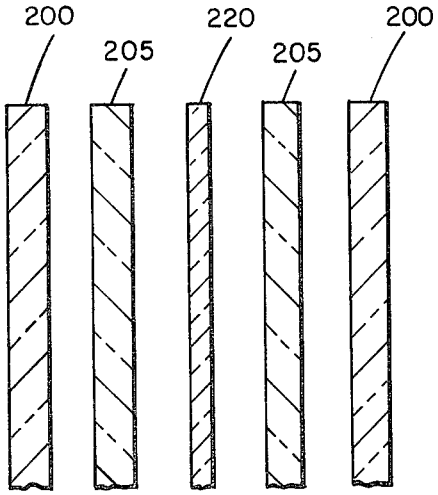
FIGS. 7A–F show the various stages for the manufacturing of the phase-shifter array of FIG. 6.
Figure 7D:
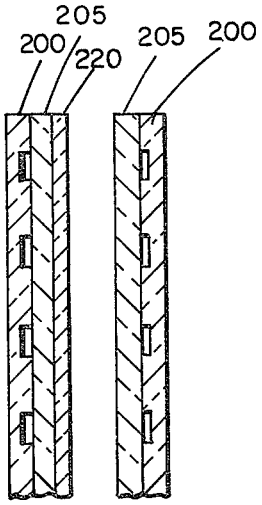
Figure 7B:
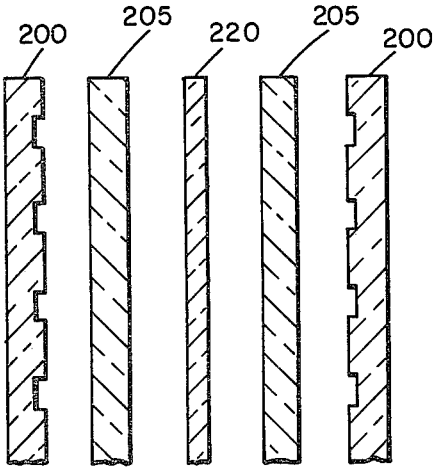
Figure 7E:
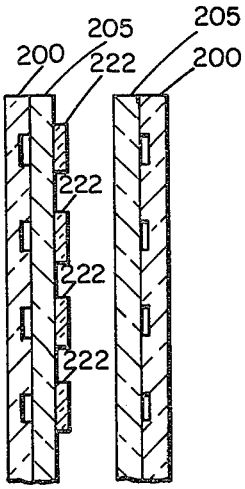
Figure 7C:
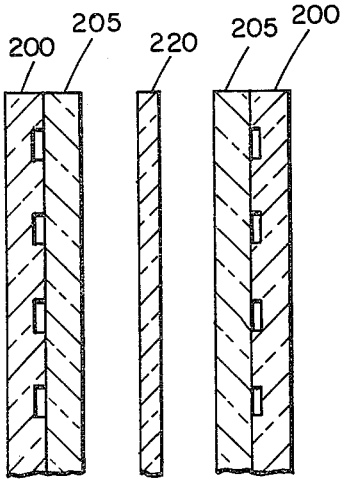
Figure 7F:
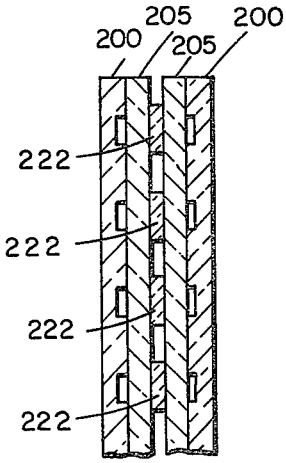

FIG. 5 shows the phase-shift for three frequencies as a function of dielectric slab thickness for the device of FIG. 3. The phase-shift decreases for thicker slabs, as expected from the decrease of the microwave fields at the ferrite dielectric interface. The phase shift also decreases overall probably due to the effect of the cladding ferrite bars, since some of the microwave energy is now confined outside the active area defined by the volume between toroids 30 and 32.

It was found that, for the frequency range used herein, a device employing a thickness of dielectric slab 20 of the order of one-third wavelength of the wave in that dielectric medium has satisfactory characteristics for a phase-shifter and does not require additional cladding to improve confinement of the wave. However, there is the option of cladding the otherwise exposed sides of the device with a dielectric material of intermediate dielectric constant to further tailor the device performance to a predetermined application.

Figure 6:
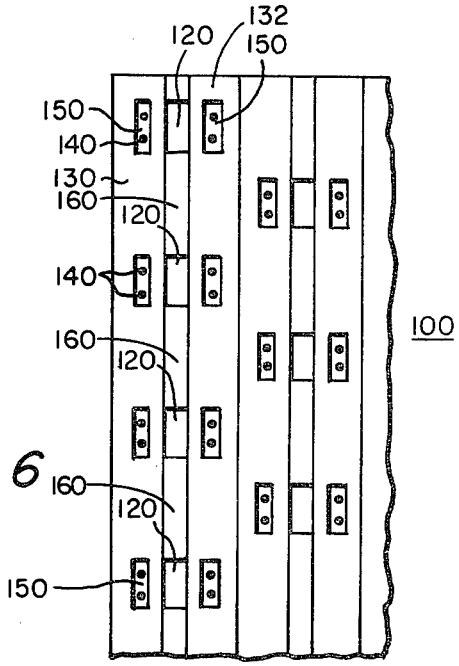
FIG. 6 shows an elevation view of an embodiment for a phase-shifter array of the present invention.

Referring now to FIG. 6, there is shown an elevation view of a phase-shifter array 100 which can be constructed using the principles of this invention. The first column of array 100 is formed by two sheets of ferrite 130 and 132 which enclose a plurality of rectangular shaped high-K dielectric bars 120. Dielectric bars 120 are positioned parallel to and at a predetermined distance from each other. The ferrite sheets have ducts 150 adjacent to and parallel to dielectric bars 120 for allowing the threading of magnetizing wires 140. The magnetic fields produced by wires 140 are confined in the ferrite region adjacent to ducts 150. The bulk of the portion of ferrite between vertical ducts is used to provide sufficient separation to achieve a level of cross-coupling below a predetermined value. The regions 160 between high-K dielectric bars 120 could be filled with low-K dielectric bars to further isolate adjacent vertical units. Additional columns may be positioned adjacent to one another to produce an array of predetermined number of phase-shifter elements.

The input and output ports for each phase shifter may be formed by extending the dielectric bars 120 beyond the input and output array surfaces. These protruding portions, not shown, can then be covered by a layer of intermediate dielectric to provide for impedance matching. The intermediate dielectric may be a dielectric button which is used to cap the protruding portions of dielectric bars 120.

Referring now to FIG. 7, there is shown the various steps for a manufacturing method suitable for producing the phase-shifter array of the present invention. Starting with FIG. 7A, there are shown the main component for forming one phase-shifter column, two sheets each of ferrite 200 and 205 and a dielectric sheet 220. The first step, FIG. 7B, is to grind grooves in the two ferrite sheets 200 for receiving the switching wires and for forming the three sides of the ferrite toroids which act as the keeper for the magnetic flux generated by the switching wires. The next step, FIG. 7C, is to bond these two keeper ferrite sheets 200 to respective ones of ferrite sheets 205. Ferrite sheets 205 provide the remaining side of the toroids and are the sides that produce phase-shift. The surface of phase-shifting ferrite 205 that is bonded to the ground surface of keeper ferrite 200 must be sufficiently smooth to avoid any air gaps, or the bonding material must have a suitable dielectric characteristic so that it can be used to fill any gap. If necessary, the phase-shifting and keeper ferrite 200 and 205 can then be ground to a predetermined thickness. The steps depicted in FIGS. 7A–C are not necessary if ferrite sheets of appropriate dimension can be extruded already containing parallel passages therein, or if it is more convenient to drill these passages on a single ferrite sheet. The next step, FIG. 7D, is to bond dielectric sheet 220 to one of the ferrite sheets 200–205 combination. It is important to use a bond that is flexible over the operating temperature range, in order to relieve the stresses that might arise due to the different coefficient of expansion between the ferrite and dielectric used in a predetermined application. If necessary, the dielectric sheet bonded to the ferrite combination can be ground to the required thickness, since the structure is now sufficiently rigid. The next step, FIG. 7E, is to grind away portions of the dielectric sheet 220 in order to form dielectric ribs 222 opposite the switching wires passages. Finally, FIG. 7F, the second ferrite 200–205 combination is bonded to the ferrite dielectric assembly. Dielectric ribs of intermediate dielectric constant may be placed between adjacent dielectric ribs 222 in order to provide further isolation between adjacent phase-shifter, as discussed hereinabove. In the event further reduction of cross-coupling is desired, it is possible to deposit a conductive layer on the two narrow surfaces of each of the dielectric ribs 222 with some small sacrifice of the phase-shift and insertion loss characteristics of the device. The dielectric sheet 220 should also overlap the ferrite 200–205 combination so that the remaining dielectric ribs 222 will protrude at either end of the phase-shifter column for providing an interface of an impedance matching element.

It is understood that although specific frequencies in the C-band are discussed hereinabove, the principles of this invention are easily used to scale the devices up or down to other frequencies. Other modifications to the described embodiments will be apparent to persons skilled in the art without departing from the spirit and scope of the invention. Accordingly, it is intended that this invention be not limited except as defined by the appended claims.

What is claimed is:

1. In combination:

means providing a dielectric waveguide having an input port and output port, comprising a dielectric and a ferrimagnetic toroid disposed adjacent to said dielectric, for confining an applied electromagnetic wave substantially in the dielectric as such electromagnetic propagates through the dielectric; and means for passing a current through said toroid to provide a magnetic field in a portion of said toroid and to provide, in response thereto, a selectable amount of phase shift to the applied electromagnetic wave propagating through said dielectric.

2. In combination:

a dielectric waveguide having an input and output port for the propagation of an applied electromagnetic wave;

a ferrimagnetic toroid disposed longitudinally adjacent to said dielectric waveguide; and means for passing a current through said ferrimagnetic toroid to produce a magnetic field in the toroid to provide in response thereto a selectable amount of phase shift as said applied wave propagates from said input to said output port.

3. The combination of claim 2 wherein:

said dielectric waveguide comprises a central dielectric member and the dielectric constant of said central dielectric member is greater than the dielectric constant of said ferrimagnetic toroid.

4. In combination:

means providing a dielectric waveguide having an input port and output port, comprising a central dielectric member and a dielectric layer along the periphery of said central member, for containing an applied electromagnetic wave substantially to the center member; and means, including a pair of toroids each comprising gyromagnetic material disposed adjacent said center member, for producing gyromagnetic interaction with a portion of said wave.

5. The combination of claim 4 wherein:

said toroid produces a predetermined selectable amount of phase shift in said wave.

6. The combination of claim 4 wherein:

said central member has a dielectric constant higher than said peripheral layer for producing outside the periphery of said central member an exponentially decaying leakage of said wave.

7. The combination of claim 6 wherein:

said central member has a cross-sectional dimension in the range of 0.25 to 0.6 of the free space wavelength divided by the square root of the relative dielectric constant of said central member.

8. In combination:

means providing a dielectric waveguide having an input port and output port, comprising a dielectric slab having a dielectric constant greater than one order of magnitude than that of free air, for containing a propagating applied electromagnetic wave substantially to the slab;

means, comprising a dielectric interface for producing a predetermined amount of wave leakage from the surface of said slab; and a pair of toroids, each one being disposed adjacent to an opposite side of said dielectric slab, for producing ferrimagnetic interaction with a first portion of said wave leakage.

9. The combination of claim 8 wherein:

the cross-sectional dimension of said dielectric slab is in the range of 0.25 to 0.6 of the free space wavelength divided by the square root of the relative dielectric constant of said central member.

10. The combination of claim 9 further comprising:

means for substantially confining a second portion of said leakage wave comprising dielectric members disposed adjacent to the sides of said dielectric slab not occupied by said ferrimagnetic means, said dielectric members having a dielectric constant greater than that of free space.

11. The combination of claim 8 wherein:

said ferrimagnetic means introduce a selectable amount of phase-shift to said applied wave.

12. A gyromagnetic device comprising:

means providing a dielectric waveguide having an input port and output port, comprising a central dielectric member having a selected cross-sectional area and a selected length, for containing a propagating electromagnetic wave substantially to the dielectric member; and a toroid comprising gyromagnetic material positioned adjacent with a portion of the length of said center dielectric member to provide a peripheral dielectric interface therebetween, with said central dielectric member and said toroid being surrounded by a dielectric medium.

13. The combination of claim 12 wherein:

the dielectric constant of said central member is higher than the dielectric constant of said toroid and the dielectric constant of said dielectric medium.

14. The combination of claim 13 further comprising:

means for producing a selectable amount of magnetic flux in said toroid.

15. The combination of claim 13 wherein:

the cross-sectional dimension of said central dielectric member is in the range of 0.25 to 0.6 of the free space wavelength divided by the square root of the relative dielectric constant of said central member.

16. In combination:

means providing a dielectric waveguide having an input port and output port, comprising an elongated slab of a first dielectric material, for guiding an electromagnetic wave;

first and second ferrimagnetic slabs disposed on a first set of opposite sides of said dielectric slab;

a dielectric layer in contact with the remaining sides of said dielectric slab means for passing a current through at least one of the ferrimagnetic slabs for producing a magnetic flux in at least one of the ferrimagnetic slabs; and wherein the dielectric constant of the dielectric slab is selected to contain the electromagnetic wave substantially to the dielectric slab.

17. The combination of claim 16 wherein:

the magnetic flux in said ferrimagnetic slabs interacts with a portion of an electromagnetic wave propagating along said first dielectric material to change the phase of said wave in response to said magnetic flux.

18. The combination of claim 16 wherein:

said elongated slab has a substantially rectangular cross-section with the smaller dimension in the range of 0.25 to 0.6 of the free space wavelength divided by the square root of the relative dielectric constant of said elongated slab.

19. In combination:

a first and second sheet of ferrimagnetic material each one thereof having opposing surface portions;

means, including a plurality of dielectric bars spaced from each other and disposed longitudinally between the opposing surface portions of said first and second sheets, for containing a plurality of electromagnetic waves fed to such plurality of bars substantially to said bars; and means, including said containing means, for coupling portions of such electromagnetic waves to adjacent portions of said sheets.

20. The combination of claim 19 wherein:

each of said sheets have longitudinal passages spaced from each other, the surface portions of said sheets being disposed parallel to each other with each passage in said first sheet being disposed adjacent a corresponding passage in said second sheet; and wherein each of said dielectric bars is disposed longitudinally between said first and second ferrite sheets in the region between oppositely adjacent passages.

21. In combination:

a ferrimagnetic material; and a plurality of dielectric waveguides each having an input port and an output port and a dielectric having a dielectric constant selected to substantially contain an electromagnetic wave fed thereto, said dielectrics being disposed adjacent to said ferrimagnetic material to provide a peripheral dielectric interface boundary between each one of the dielectrics and the ferrimagnetic material.

22. The combination of claim 21 wherein:

said ferrimagnetic material includes a plurality of longitudinal passages at a predetermined spacing from each other; and wherein each one of said dielectrics is disposed adjacent the region of the plurality of longitudinal passages.

23. The combination of claim 21 wherein:

said dielectrics have a cross-sectional dimension in the range of 0.25 to 0.6 of the free space wavelength divided by the square root of the relative dielectric constant of said dielectrics.

24. The combination of claim 22 further comprising means disposed through said passages for providing magnetic flux in the region of the plurality of longitudinal passages.

25. In combination:

a ferrimagnetic material;

dielectric means for guiding a plurality of applied electromagnetic waves, comprising a plurality of spaced dielectric material, and portions of said ferrimagnetic material, to provide a dielectric layer along a portion of the periphery of said plurality of spaced dielectric members; and means for passing a current through said ferrimagnetic material for producing magnetic flux in said ferrimagnetic material.

26. The combination of claim 25 wherein:

said ferrimagnetic material includes a plurality of longitudinal passages at predetermined spacing from each other; and wherein each spaced dielectric member is disposed adjacent the region of the plurality of passages.

27. The combination of claim 25 wherein:

said means for passing a current through the ferrimagnetic material further comprises a plurality of conductors disposed to produce in response to a plurality of signals fed thereto, a plurality of substantially independent magnetic fields in regions of said ferrimagnetic material adjacent said plurality of spaced dielectric members.

28. The combination of claim 26 further comprising means disposed in said passages for producing a plurality of substantially independent magnetic fields in regions of said ferrimagnetic material disposed adjacent such plurality of spaced dielectric members.

* * * * *